US005211207A

United States Patent [19]

Ichikawa

[11] Patent Number: 5,211,207

[45] Date of Patent: May 18, 1993

[54] WEFT FEEDER FOR WEAVING MACHINE WITH ANGULARLY ADJUSTABLE CARRIER

[75] Inventor: Michihiro Ichikawa, Kiryu, Japan

[73] Assignee: Ichikawa Iron Works Co., Ltd., Kiryu, Japan

[21] Appl. No.: 810,838

[22] Filed: Dec. 20, 1991

[30] Foreign Application Priority Data

| | | | |
|---|---|---|---|
| Dec. 21, 1990 | [JP] | Japan | 2-413085 |
| May 22, 1991 | [JP] | Japan | 3-117594 |
| Jul. 31, 1991 | [JP] | Japan | 3-191979 |

[51] Int. Cl.[5] ..... D03D 47/34

[52] U.S. Cl. ..... 139/452; 242/47.01

[58] Field of Search ..... 139/452; 242/47.01

[56] References Cited

U.S. PATENT DOCUMENTS

| | | | |
|---|---|---|---|
| 3,971,522 | 7/1976 | Pfarrwaller | 139/452 X |
| 4,632,154 | 12/1986 | Maina | 139/452 |
| 4,638,840 | 1/1987 | Ghiardo et al. | 139/452 |
| 4,747,549 | 5/1988 | Balzarotti | 242/47.01 X |
| 5,069,395 | 12/1991 | Kromm | 139/452 X |

*Primary Examiner*—Andrew M. Falik

*Attorney, Agent, or Firm*—Weintraub, DuRoss & Brady

[57] ABSTRACT

A feeder for supplying a warp to a weaving machine is described. The feeder includes a drum non-rotatably supported by a drum shaft, a driving section connected to the drum shaft, a flyer wrapping warp around the drum, the flyer being supported by and rotatable with the drum shaft, a warp sensor pivotably supported in one of a plurality of slits formed in the drum, at least one supporting member eccentrically movable and slantable with respect to the drum shaft, and at least one carrier born by the at least one supporting member and guided by the plurality of slits respectively to be movable in both an axial direction and in a radial direction. The flyer transport the warp wound about the drum in the axial direction with the supporting member rotatably mounted on the drum shaft. A dial having a cam-like slant surface is attached to the drum shaft so as to enable a inclination angle adjustment of the slant surface. By the adjustment of the dial, the supporting member is inclined. This facilitates pitch adjustment of the feeder without the necessity of disassembling the unit. The sensor member can be operated with a very slight touch, giving a more sensitive sensor. Thus a clutch for preventing reverse rotation is provided between the driving section and the flyer, making it possible to prevent reverse rotation of the motor due to the tension of the warp, exerted when the flyer is stopped. This prevents the application of torsion upon the warp and the degrading thereof of the warp.

6 Claims, 9 Drawing Sheets

WEFT FEEDER FOR WEAVING MACHINE WITH ANGULARLY ADJUSTABLE CARRIER

BACKGROUND OF THE INVENTION

1. Field of the Invention

The present invention relates to a feeder for supplying a weft to a weaving machine having no reed, such as a rapier type weaving machine.

2. Description of the Prior Art

Generally, in this type of weaving machine or loom, the size of a weft-wound ball from which weft is fed to the weaving machine decreases as the weft is consumed. Correspondingly, the pull or draw-out tension varies as the weft-wound ball reduces in diameter. Therefore, a feeder is required to feed the weft to the weaving machine so as to maintain a constant feeding tension of the weft.

One weft feeder of this type is disclosed in Japanese Patent Laid-Open Publication No. 60-259654. In this weft feeder, as shown in FIG. 14 hereof, a weft Y is wound about a drum 10 by means of a rotary reel or flyer 14. The wound weft Y is advanced by the action of a carrier 23, which extends and retracts from an outer peripheral surface of the drum 10. A base portion 5 of the carrier 23 is rotatably attached to a bushing 7, which is eccentrically fitted and secured to a drum shaft. The axis center of the base portion 5 is inclined with respect to the drum shaft 13. The drum 10 and the carrier 23, however, do not rotate. Accordingly, when the bushing 7 is rotated together with the drum shaft 13, the carrier 23, which is rotatably attached to the bushing 7 through the base portion 5, is oscillated back and forth, as shown by the broken lines. While the carrier 23 is protruding and retracting from the surface of the drum 10, depending on the angle of inclination and the amount of eccentricity of the bushing 7, the carrier 23 operates to advance the weft Y off the front of the drum 10.

A problem occurs where the weft is a nylon twisted yarn having substantially no nap. The weft fed to the weaving machine is naturally twisted. Therefore, it is necessay to reverse the direction of winding, depending on the direction of twisting of the weft, i.e., Z-twisting or S-twisting. Specifically, it is always necessary when feeding the weft to wind the warp not in the direction in which the twist is released, but rather in the direction in which the twist is tightened. To attain this, it is necessary to change the direction of inclination of the bushing 7.

In this known feeder, it is inconvenient to change the inclination of the bushing 7. The setting and changing of the weft-feeding pitch, and the setting and changing of the direction of movement of the carrier, with respect to the direction of rotation of the flyer, cannot be accomplished without disassembling the feeder.

In a weft feeder of this known type, and as shown in FIG. 15, sensor members 41 are provided that are pivotably supported within slits formed radially from the inside of the drum 10. A bearing member 41*a* pivotably supports each sensor member 41. Each sensor member 41 extends outwardly from each slit beyond the surface of the drum 10. One sensor member detects the presence of weft wound about the base portion of the drum 10. The second sensor member detects the amount of weft feeding past the flyer.

A coil spring 83 is used as a biasing spring for making a part of each sensor member 41 protrude above the outer surface of the drum 10. Generally, in the case of the coil spring 83, a certain load is necessary to supply tension until the coil spring 83 begins expansion. Since the coil spring 83 has its own weight, a first side 41*c* of the sensor member 41 is made heavier than a second side 41*b*, so that balance is achieved about the fulcrum 41*a*. Any response is slow due to the action of the moment of inertia. The detection of the weft with a light touch, as light as 0.5 g or less, is impossible. Furthermore, a malfunction sometimes occurs due to the deposition of dust, down or weft between the coils of the coil spring 47. Such situations are undesirable.

Furthermore, in the weft feeder of this type, the flyer stops when winding the weft about the drum 10 is finished. The flyer restarts supplying the weft when the residual quantity of weft is reduced. Thus, after the motor is decelerated by inverter control, the flyer will ultimately stop. As a result, a characteristic of the flyer decelerating and stopping is noted; specifically, the flyer rotates to a small extent in a reverse direction before stopping. This is due to the tension in the weft.

This characteristic of the flyer driving system sometimes causes a serious problem. A defect, independent of the direction of twist of the weft, occurs with respect to the tension applied to the weft. More specifically, in supplying the weft to the drum, the direction the weft is wound and the tension of feeding of the weft are controlled so that a natural twist is always applied to the weft. However, when the flyer is rotated in a reverse direction, the force restricting the twisting of the weft does not act anymore. As shown in FIG. 13B, a torsion phenomenon is caused in which a part of the weft is folded and twisted, as compared with a normal state shown in FIG. 13A. The weft, having such a twisted portion, is seldom restored to its original state. If a considerable tension is applied to the weft to restore the original state, the strength of this portion of the weft is significantly degraded. Accordingly, when the flyer is restarted, the degraded weft is fed to a weaving machine. The woven cloth manufactured with this degraded weft will have this a defect therewithin. Alternatively, the weft could break at the degraded portion, causing a malfunction in the weaving machine.

SUMMARY OF THE INVENTION

The present invention eliminates the above-identified defects and problems. It is an object of the present invention to provide a weft feeder having means for setting a weft feed pitch, and means for changing the direction of movement of a carrier with respect to the direction of rotation of a flyer with a simple, single manipulation.

Another object of the present invention is to provide a weft feeder having means for sensitively detecting a weft on a drum.

Still another object of the present invention is to provide a weft feeder having means for suppressing the feeding of defective weft to a weaving machine, where the defect comprises a degraded portion of weft produced by reverse rotation applied to the weft when the flyer is stopping.

A feeder for supplying weft to a weaving machine, in accordance with the present invention, the feeder comprising:

(a) a frame;

(b) a drum shaft having a central axis;

(c) means for rotating the drum shaft, the means for rotating being mounted on the frame;

(d) a drum mounted upon the drum shaft, the drum having a plurality of radial slits formed therein;
(e) a flyer mounted upon and rotatable with the drum shaft;
(f) at least one carrier which is radially and axially movable with respect to the drum shaft;
(g) means for supporting the at least one carrier upon the drum shaft, the means for supporting being oriented at an angle of inclination with respect to the central axis of the drum shaft; and
(h) means for adjusting the angle of inclination of the means for supporting.

In the weft feeder of the present invention, the means for supporting is rotatably mounted on the drum shaft through a bushing having an eccentric surface at an outer side. An eccentric wheel is coupled to the bushing in a universal coupling fashion. A bearing is axially mounted in the drive shaft over the wheel, completing the securing of the supporting means. A dial having a slant or cam surface at a first side is attached to the outer portion of the drum shaft so that phase adjustment of the slant surface is possible. By the adjustment of phase rotation of the dial with respect to the drum shaft, the means for supporting is pushed by the slant surface and inclined. Accordingly, by the adjustment of the dial, the weft feed pitch and the direction of movement of the carriers with respect to a direction of rotation of the flyer can be set and changed with a simple, single operation.

Furthermore, a pin-like spring biases a means for detecting, allowing the means for detecting to operate with a light touch without being affected by either an initial tension, its own weight, or dust from the weft, as occurs with a coil spring.

The present invention may further comprise a clutch disposed between the means for rotating and the flyer to prevent reverse rotation. The tension of the weft will prevent reverse rotation as the flyer stops. As a result, torsion in the weft, which would otherwise be caused when the flyer is rotated in a reverse direction, is prevented, as is the degrading effect of the reverse rotation on the weft.

DETAILED DESCRIPTION OF THE PREFERRED EMBODIMENTS

Figure 1:
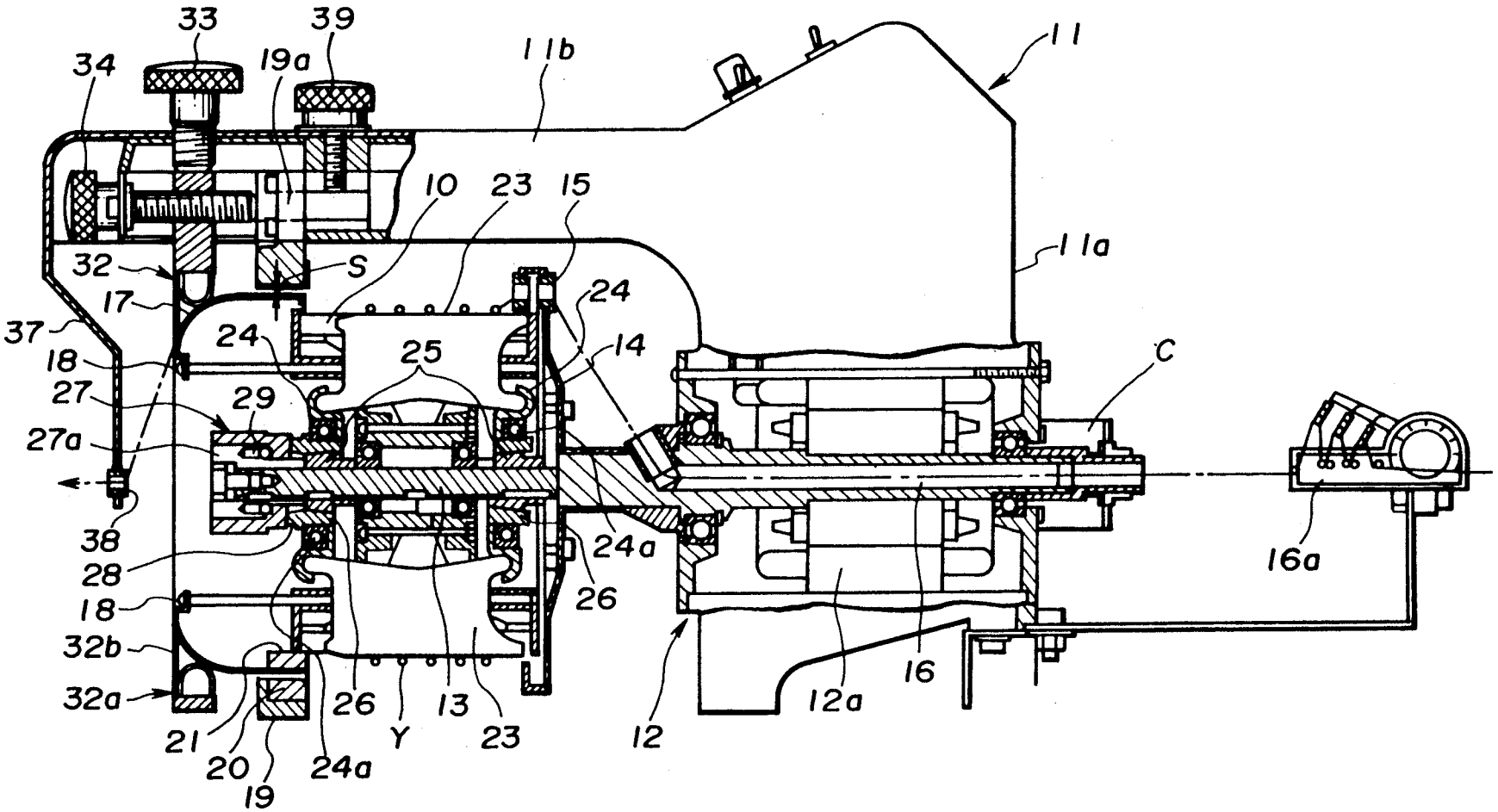
FIG. 1 is a front sectional view of the weft feeder of the present invention.
Figure 2:
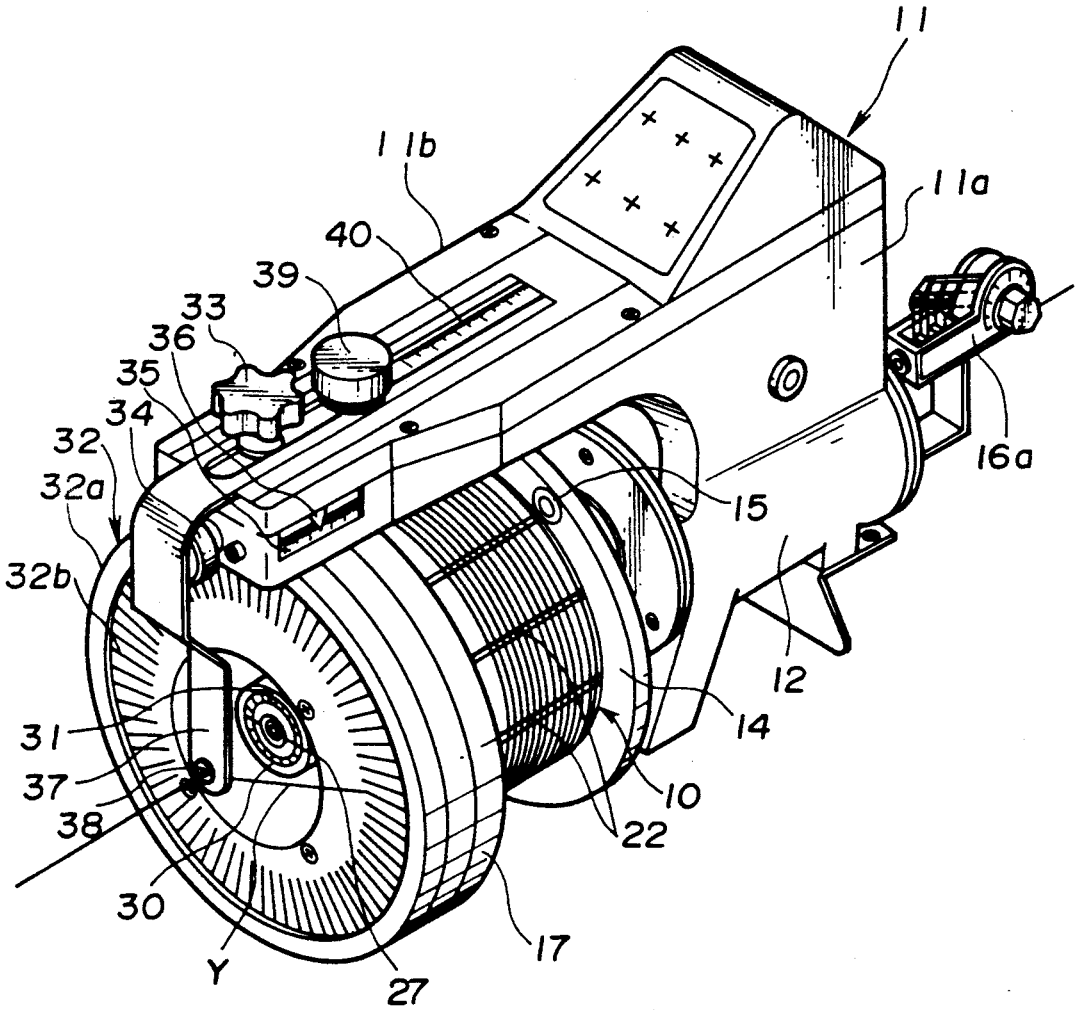
FIG. 2 is a perspective view of the weft feeder of the present invention.

With reference to FIGS. 1 and 2, the weft feeder of the present invention comprises an inverted L-shaped frame 11. A means for rotating 12 is disposed inside the frame in parallel to an upper portion **11*b* of the frame 11. The means for rotating 12 is mounted on a base portion 11*a* of the frame 11** and extends horizontally therefrom.

The means for rotating 12 includes a 3-phase induction motor **12*a*, whose rotational speed is controlled by an inverter (not shown), and a clutch C. The clutch C connects the motor 12*a* and a rear end of the frame 11. The clutch C acts to brake and stop the motor 12*a***.

A drum shaft 13 extends from the means 12 for rotating, and extends horizontally in a direction away from the base portion **11*a* of the frame 11. A drum 10 is deployed axially on the drum shaft 13. The drum 10 is free to remain stationary independent of the rotation of the drum shaft 13. Thus, the drum 10 is stationary with respect to the drum shaft 13 when the drum shaft 13** rotates.

The motor **12*a* is driven to accelerate or decelerate within a predetermined frequency range, so that the winding speed of winding of the weft Y by a flyer 14**, described in further detail herein below, is controlled at a constant rate.

The flyer 14 is mounted upon and is integral with the drum shaft 13. The flyer 14 is disposed on a side of the drum proximate to the means for rotating 12. The flyer 14 has formed therein a weft hole 15 at an outer end thereof. The flyer 14 is rotated together with the drum shaft 13, winding the weft Y about the outer peripheral surface of the drum 10. The weft Y passes through a weft passage 16 axially formed through the drum shaft 13. The weft Y passes out of the drum shaft 13 and through the weft hole 15. A weft feed guide **16*a* leads the weft Y, drawn from a weft ball, to the weft passage 16** and adjusts the tension of the weft Y.

An annular cap 17 covers a front side of the drum 10, the front side being opposite the drum side proximate to the means for rotating. The cap 17 is secured to the front side of the drum 10 by a snap member 18. An annular frame 19 surrounds the annular cap 17 forming a constant gap S therebetween. The weft Y is released from the drum surface, passing through the gap S along the outer periphery of the annular cap 17. The annular frame 19 attached to the frame 11 by a fixing portion 19*a*.

A first plurality of magnets 20 is disposed on an inner peripheral surface of the annular frame 19. A second plurality of magnets 21, equal in number to the first plurality of magnets 20, is disposed on an inner peripheral surface of the annular cap 17, so that the first plurality 20 and second plurality 21 of magnets correspond to each other. Due to the attracting action of the magnets 20 and 21, the annular cap 17 and the drum 10, which are integral with each other, do not rotate with the drum shaft 13.

The drum 10 has formed therein a plurality of slits 22 at equal intervals spaced in a circumferential direction therearound. The slits 22 extend radially from the center portion of the drum 10 towards the outer peripheral surface. At least one carrier is accommodated in the slits 22. As shown in FIG. 1, two carriers 23 and 23' protrude from and retract into the outer peripheral surface of the drum 10. The carriers 23 and 23' are movable to transport the weft Y. The weft Y is wound about the base portion of the drum 10, turn by turn, forward of the drum 10. Each carrier is formed in a substantially rectangular shape. The carriers 23 and 23' are supported by two opposing annular supporting members 24 and 24'. The supporting members are denoted as a first supporting member 24 and a second supporting member 24'. The eccentric rings 26 are mounted on the drum shaft 13. The eccentric rings 26 are coupled with bushings 25, which are fixed to the drum shaft 13, in a fashion similar to a universal joint. The supporting members 24 and 24' are mounted upon the eccentric ring 26 in such a manner as to allow rotation of the ring 26 while the supports 24, 24' do not rotate. Bearings 24*a* secure the supporting members 24 and 24' to the eccentric rings 26. Thus, the carriers 23, 23' are coupled to the supporting members 24 and 24' and performs a linked-operation. The supporting members 24 and 24', the eccentric rings 26, the bushings 25 and the bearings 24*a* comprise means for supporting the at least one carrier upon the drum shaft 13.

A dial 27 is attached to an outer end of the drum shaft 13, proximate the front end of the drum 10. A slant or cam surface 28 is provided on an inner end of the dial 27. The slant surface 28 is in slidable contact with the eccentric ring 26 of the supporting member 24. The dial 27 has a notch mechanism 29 interposed between the dial 27 and a shaft securing portion 27*a*. The notch mechanism 29 comprises a plurality of balls, a spring elastically pressing the balls and a ball-fitting recess. The dial 27 can be fixed to the drum shaft 13 at an arbitrary rotational position. Thus, the dial 27 is rotated concurrently with the drum shaft 13. The rotation of the dial 27 makes the first supporting member 24 slant in a direction corresponding to the slant surface 28, which contacts the ring 26. In this case, the other supporting member 24 located at an inner side of the frame 11 and linked through the carriers 23 to the first-mentioned supporting member 24 is also slanted. By rotating the dial 27 against the securing force of the notch mechanism 29, the inclination of the slant surface 28 is changed. Thus, the initial attitude of the supporting members 24 and 24' can be adjusted.

An angular scale 30 is inscribed in a front surface of the drum shaft 13, as shown in FIG. 2. A pointer 31 is provided in the dial 27 so that the angle of inclination of the first supporting member 24, of the second supporting member 24', with respect to the axis of the drum shaft 13, can be seen at a glance.

An annular brush 32 has a bristle portion 32*b* bonded to an inner peripheral surface of an annular frame 32*a*. The annular brush 32 is mounted on the lower surface of the upper portion 11*b* of the frame 11. The brush 32 is movable forwardly and rearwardly. The tip of the bristle portion 32*b* is slidably in contact with the front surface of the annular cap 17. The annular brush 32 serves as a means for applying tension to the weft Y by positioning the weft Y between the annular brush 32 and the annular cap 17. The bristle portion 32*b* of the brush 32 is not limited in its composition to bundles of fibrous material, but may comprise any suitable material. The weft Y is supplied to the weaving machine (not shown) by releasing the weft Y wound around the outer surface of the drum 10, and the weft is then positioned between the annular brush 32 and the annular cap 17.

A bolt 33, having a handle, interlocks with the annular brush 32. A fine adjustment bolt 34, in contact with the bolt 33, adjusts the frictional force of the brush 32 by its rotation after releasing the bolt 33. The rotation of the fine adjustment bolt 34 allows small adjustment of the tension of the weft Y by moving the annular brush 32 forwardly or rearwardly. Thus, when the tip of the bristle portion 32*b* applies a larger pressure by moving the annular brush 32 rearwardly, the tension on the weft Y is increased. Conversely, when the annular brush 32 is moved forwardly, the tension on the weft Y is decreased.

A scale 35 indicates the brush pressure on the annular cap 17 and weft. The scale 35 is provided on a side surface of the upper portion 11*b* of the frame 11. A pointer mark 36 of the scale 35 is moved concurrently with the annular brush 32.

A top guide 37 is attached to an upper surface of the upper portion 11*b* of the frame 11 by a clamping knob 39. The top guide 37 is movable forwardly and rearwardly. The top guide 37 has a weft eyelet 38 formed therein which directs the weft Y on a line colinear with the axis of the drum shaft 13, after the weft Y passes between the bristle portion 32*b* of the annular brush 32 and the annular cap 17. The weft Y is passed such that it forms a balloon shape. Since the size of the balloon or the degree of expansion of the balloon drawn by the weft Y changes depending upon the thickness and type of the weft. The top guide 37 is positioned according to the type of weft being used.

A position indicating scale 40 for the top guide 37 is provided on the upper surface of the upper portion 11*b* of the frame 11.

Figure 3:
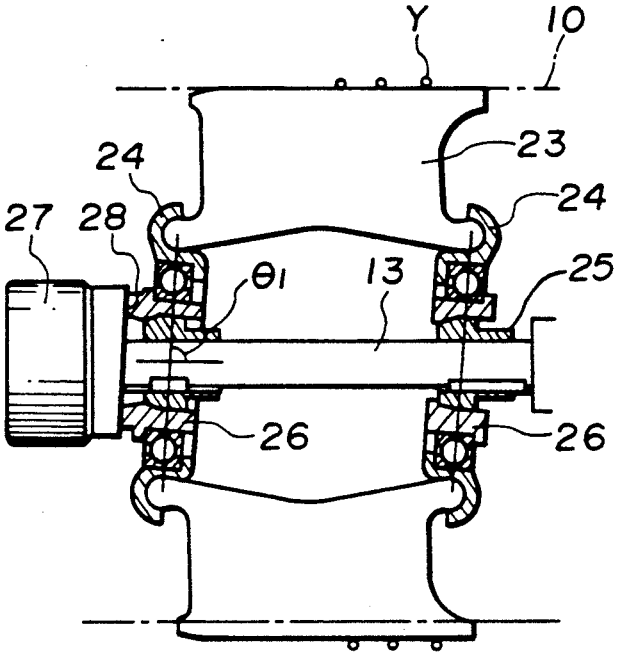
FIG. 3 is an enlarged view of a portion of the weft feeder, showing an intial attitude of the support member and carriers when the drum shaft is rotated in a forward direction.

As shown in FIG. 3, the initial attitude of the supporting members 24 and 24' with respect to the drum shaft 13 is inclined at the angle of $\theta 1$ by the dial 27. Each of the eccentric rings 26 has a thick wall side and a thin wall side.

When the drum shaft 13 is rotated by the means for rotating 12, the weft Y, emitting from the weft hole 15, winds about the outer peripheral surface of the drum 10 due to the rotation of the flyer 14. The supporting members 24 and 24' oscillate vertically with the eccentric rings 26 by the rotation of the drum shaft 13. Simultaneously, the supporting members 24 and 24' move forwardly and rearwardly, sliding upon the slant surface 28.

Figure 4:
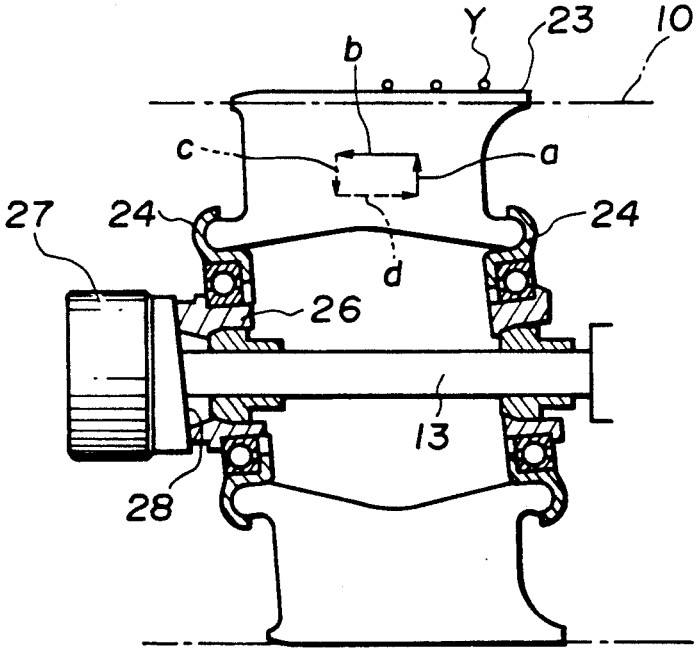
FIG. 4 is an enlarged view of a portion of the weft feeder, showing a moving state of the support member and the carriers when the drum shaft is rotated by 180 degrees from the state of FIG. 3.

FIG. 4 shows the inclination of the carriers 23 and 23'. The condition shown in FIG. 4 is attained when the drum shaft 13 is rotated by 180 degrees from the condition shown in FIG. 3. Thus, inclination of the slant surface 28 of the dial 27 shown in FIG. 4 is opposite to that shown in FIG. 3. Specifically, the thick wall portion of each eccentric ring 26 is positioned above the drive shaft 13 and the thin wall portion is positioned below. The carrier 23 positioned on the upper side of the drive shaft 13 is supported by the supporting members 24 and 24'. The carrier 23 is advanced along the arrow b while moving upwardly along the arrow a. Accordingly, the outer edge of the carrier 23 scoops the weft Y wound about the outer peripheral surface of the drum 10 and transports the weft Y forwardly. When the drum shaft 13 is further rotated, the carrier 23 retreats along the broken line arrow d and moves rearwardly along the broken line arrow c, returning to the condition of FIG. 3. This completes one-cycle operation or one-pitch transportation. This amount of transportation or pitch is determined by the inclination angle $\theta 1$ of the initial attitude of the supporting members 24 and 24' as set by the dial 27. Therefore, the greater the inclination angle of the initial attitude, the larger the amount of transportation resulting.

Figure 5:
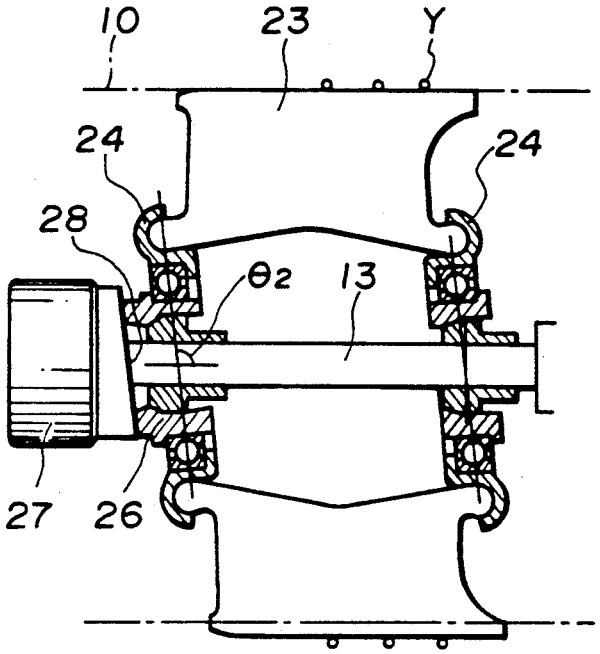
FIG. 5 is an enlarged view of a portion of the weft feeder, showing an initial attitude of the support member and the carriers when the drum shaft is rotated in a reverse direction.

When it is necessary to reverse the rotation of the drum shaft 13 for weft having twisting of an opposite rotation, only the dial 27 is rotated while the drum shaft 13 is fixed. The initial attitude of the supporting members 24 and 24' incline forwardly at an inclination angle $\theta 2$, as shown in FIG. 5. The thin wall portion of each eccentric ring 26 is positioned above the drive shaft 13 and the thick wall portion is positioned below the drive shaft 13. The outer edge of the carrier 23 is supported by the supporting members 24 and 24' and is positioned at the upper side. The carrier 23' is retracted from the outer peripheral surface of the drum 10.

Figure 6:
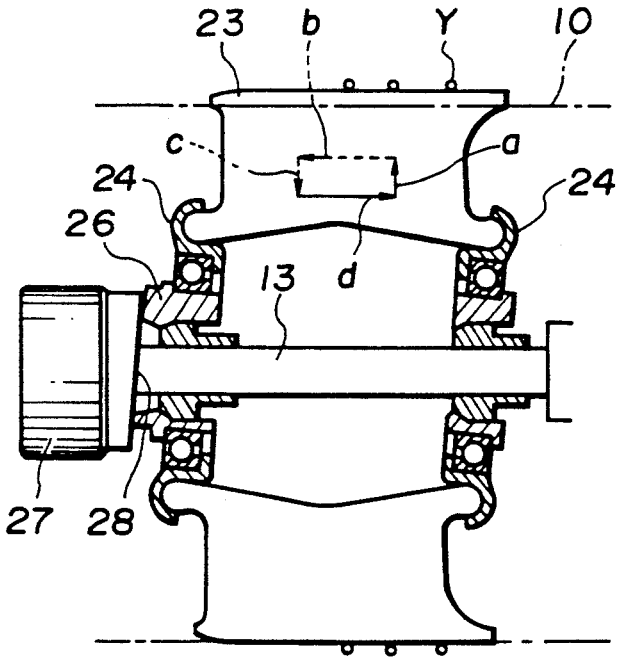
FIG. 6 is an enlarged view of a portion of the weft feeder, showing a moving state of the support member and the carriers when the drum shaft is rotated by 180 degrees from the state of FIG. 5.
Figure 7:
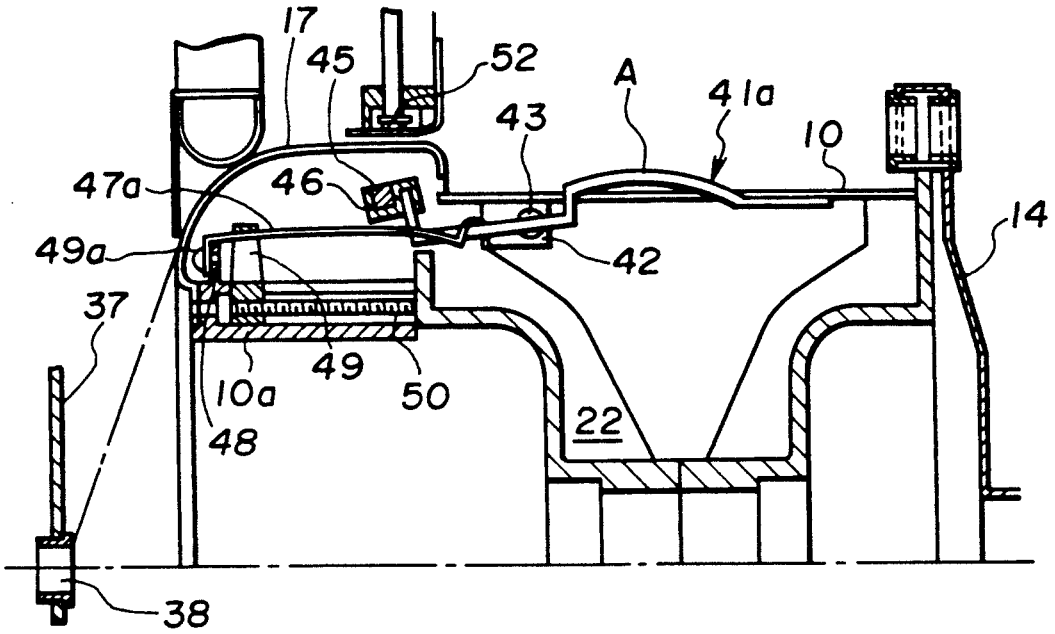
FIG. 7 is a sectional view of a portion of the weft feeder, showing a state in which a part of a weft wound quantity detection sensor is protruded from an outer peripheral surface of the drum.

When the drum shaft 13 is rotated, the weft Y is wound about the outer peripheral surface of the drum 10 in the opposite direction by the flyer 14. The drum shaft 13 is then rotated 180 degrees from the condition shown in FIG. 5, to the condition shown in FIG. 6. When the direction of the slant surface 28 of the dial 27 is reversed, the carrier 23 is positioned at the upper side and supported by the first supporting member 24. The carrier 23 is made to move upwardly along the arrow a while retreating along the arrow d. As a result, the outer edge of the carrier 23 scoops the weft Y, which is wound about the outer peripheral surface of the drum 10 at the retreat point. When the drum shaft 13 is further rotated, the carrier 23 is moved downwardly along the broken line arrow c while advancing along the broken line arrow b, and returns to the condition shown in FIG. 5. In other words, the weft Y is transported forwardly by one pitch from the retreat point of the upwardly moved point to the advanced point.

When the supporting members 24 and 24' remain as set to the rearward inclination $\theta 1$, similar to FIG. 3, the drum shaft 13 is rotated in a reverse direction. The carriers 23 and 23' then transport the weft Y wound about the drum 10 in a rearward direction.

As described in the foregoing, the carriers 23 and 23' are supported by the supporting members 24 and 24', whose inclination angle with respect to the drum shaft 13 is variable by changing the orientation of the ring 26 with respect to the bushing 25. The supporting members 24 and 24' are pivotably supported and eccentrically movable. Further, the dial 27 is provided at the outer end portion of the drum shaft 13 such that the dial 27 is rotated concurrently with the drum shaft 13 to incline the supporting members 24 and 24' in the forward and rearward directions. The dial 27 has the slant surface 28, which enables the setting and changing of the initial inclination angle of the supporting members 24 and 24'. As a result, it is possible, by manipulation of the dial 27, to set the weft transporting pitch, and to set the transporting direction by the carriers 23 and 23'.

Figure 11:
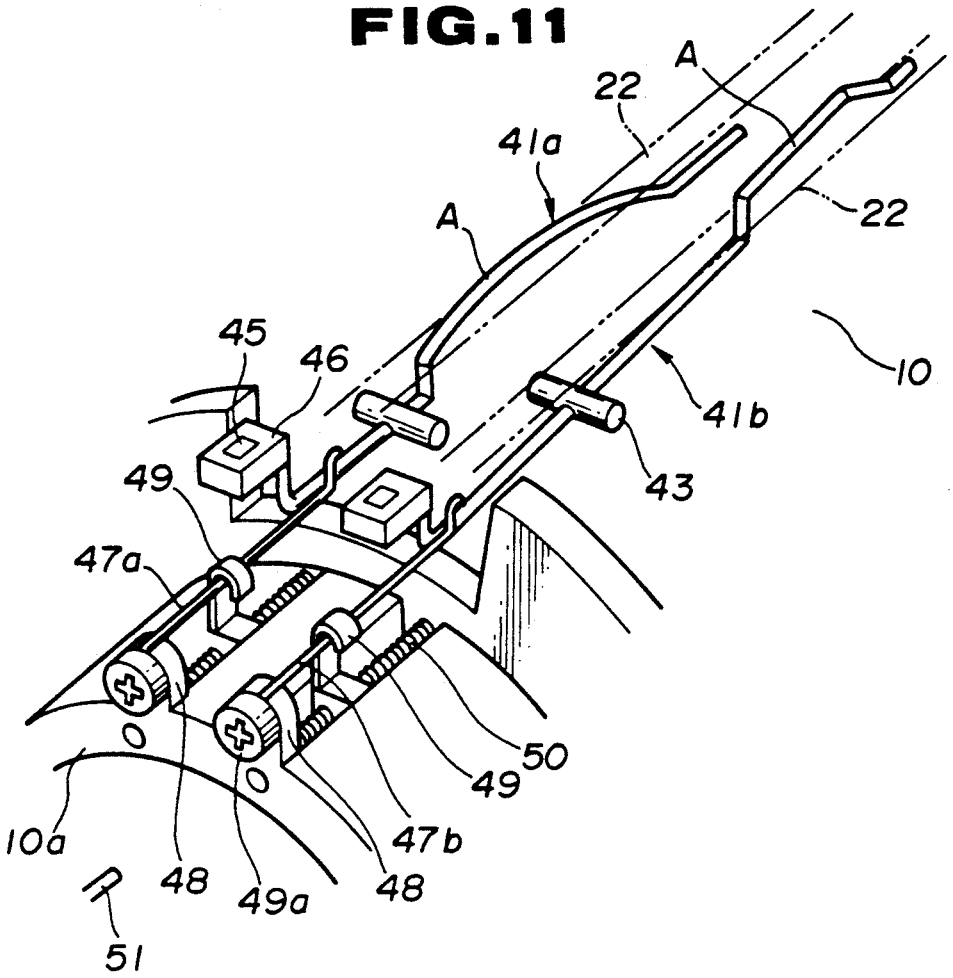
FIG. 11 is a perspective view of a top section of the weft feeder, showing a mounting state of the weft wound quantity detection sensor and the weft exhaustion detection sensor.

FIG. 11 is a perspective view of an upper part of the drum 10, where the frame 11 is removed for the purposes of illustration. As seen in FIG. 11, sensors 41*a* and 41*b* are accommodated in two slits 22 and 22' located just below the frame 11. The slits 22 and 22' accommodate the sensors 41*a* and 41*b* instead of the carriers 23 and 23'.

With reference to FIGS. 7 to 10, the sensors 41*a* and 41*b* will be described in detail.

The sensor 41*a* detects the amount of weft Y wound about the outer peripheral surface of the drum 10. The sensor 41*b* detects when the amount of weft is dwindling or is exhausted. The sensors 41*a* and 41*b* are pivotably supported through pins 43*a* and 43*b* by bearing members 42*a* and 42*b*. The sensors 41*a* and 41*b* are accommodated in the two slits 22 and 22' and positioned beneath the upper portion 11*b* of the frame 11. The sensors 41*a* and 41*b* move in a seesaw fashion. Front ends 44*a* and 44*b* of the respective sensors 41*a* and 41*b* extend to reach the annular cap 17. Blocks 46*a* and 46*b* have magnets 45*a* and 45*b* embedded therein. The blocks 46*a* and 46*b* are disposed at the front ends 44*a* and 44*b* of the sensors 41*a* and 41*b*.

Pin springs 47*a* and 47*b* have their base portions respectively fixedly supported by protruding pieces 48*a* and 48*b* with screws 49*a* and 49*b*, which are provided in parallel to each other on an outer surface of a front frame 10*a* of the drum 10. Tip ends of the pin springs 47*a* and 47*b* are formed in a hook shape. These hook shaped portions are held at front end portions of the sensors 41*a* and 41*b*. Normally, a portion A of the sensor arm is bent in a convex shape and disposed at a rear end side of each of the sensors 41*a* and 41*b* and is exposed or protruded to the outside of the slits 22 and 22'. Movable support members 49 and 49' are moved by rotating screw bars 50 with screw driver 51. The screw driver 51 is fitted into the front frame 10*a* of the front surface of the drum 10 from a front surface by a jig, thereby to enable to adjust a spring force of the pin springs 47*a* and 47*b*.

Hall elements 52 and 52' are provided above the annular cap 17 so that the resistance values are varied depending on the attraction or resistance of the magnets 45*a* and 45*b* embedded in the blocks 46*a* and 45*b*, which are and fixed respectively to the sensors 41*a* and 41*b*. The Hall elements 52 and 52' deliver information to a control unit (not shown) as to the amount of wound weft detected by the sensor 41*a* and the exhaustion of weft detected by the sensor 41*b*.

In operation in this embodiment, as shown in FIG. 1, the weft Y passes through the weft passage 16 in the drum shaft 13. The weft Y further passes through the weft hole 15 at the outer end of the flyer 14. The weft Y is then wound about the outer peripheral surface of the drum 10. The weft Y is drawn out through the gap S between the annular cap 17 and the annular frame 19. The weft Y is supplied to the weaving machine through a weft eyelet 38 in the top guide 37.

Thereafter, the dial 27 is adjusted, taking into consideration the manner of twisting for the weft and the thickness thereof to set a direction of inclination and a slant angle of the supporting members 24 and 24'. Then, the drum shaft 13 is rotated in a predetermined direction. When the weft Y is wound about the outer peripheral surface of the drum 10 by the flyer 14, due to the rotation of the drum shaft 13, the carriers 23 and 23', supported by the supporting members 24 and 24', perform a predetermined square movement, as shown in FIG. 4, to transport the forwardly wound weft Y.

Figure 8:
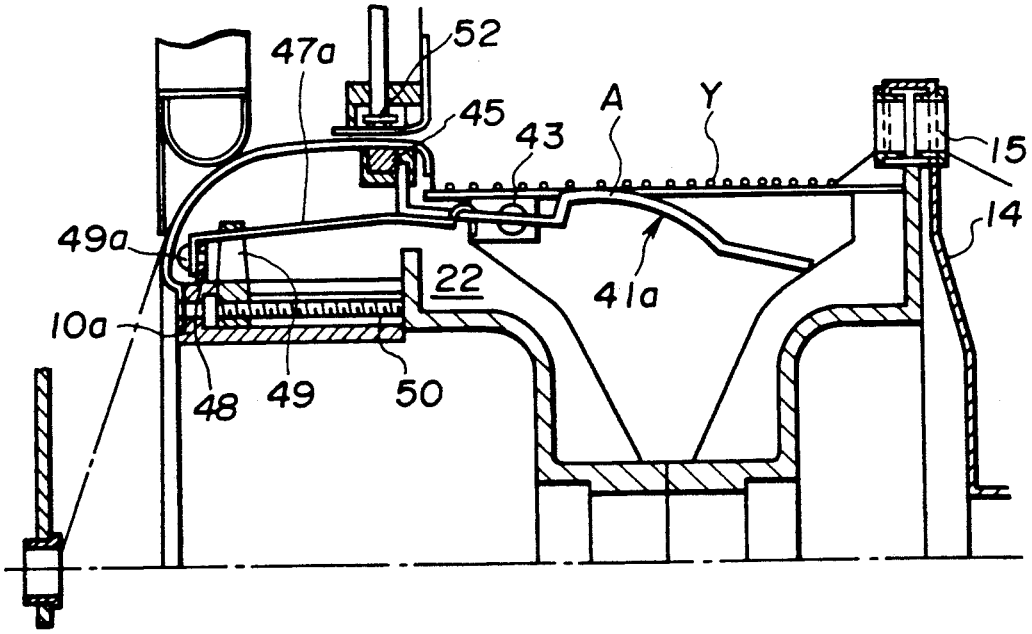
FIG. 8 is a sectional view of a portion of the weft feeder, showing a state in which the part of the weft wound quantity detection sensor is retracted into the outer peripheral surface of the drum.
Figure 9:
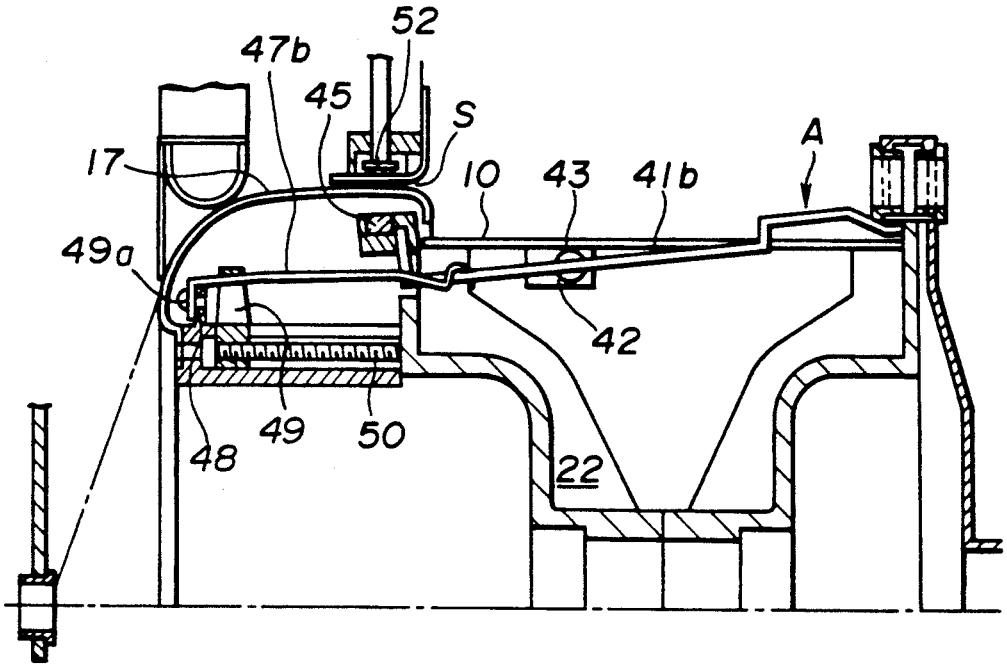
FIG. 9 is a sectional view of a portion of the weft feeder, showing a state in which a part of a weft exhaustion detection sensor is protruded from the outer peripheral surface of the drum.
Figure 10:
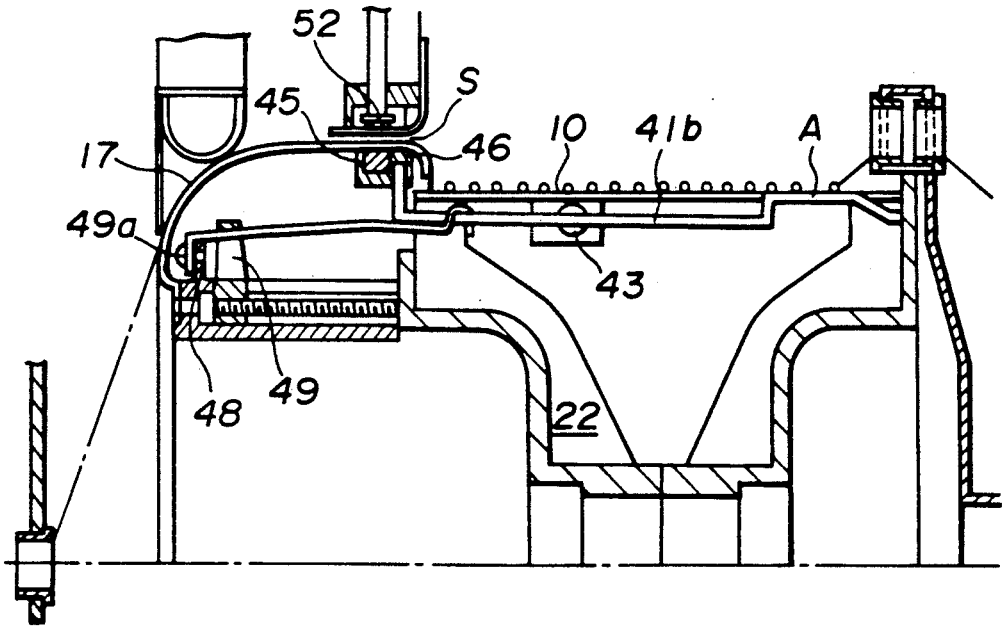
FIG. 10 is a sectional view of a portion of the weft feeder, showing a state in which the part of the weft exhaustion detection sensor is retracted into the outer peripheral surface of the drum.

In this manner, when the weft Y is wound about the outer peripheral surface of the drum 10, the sensors 41*a* and 41*b* are moved to the states as shown in FIGS. 8 and 10 so that the magnets 45*a* and 45*b* embedded in the blocks 46*a* and 46*b* and fixed to the front ends of the sensors 41*a* and 41*b* are moved closer to the Hall elements 52 and 52'.

When the magnet 45*a* of the sensor 41*a* approaches the Hall element 52, the amount of weft Y wound about the outer peripheral surface of the drum 10 is detected and that information is relayed to the control unit (not shown). Simultaneously, the rotation of the drum shaft 13 is stopped. The weft Y wound about the outer peripheral surface of the drum 10 is supplied to the weaving machine releasing the weft Y wound about the drum peripheral surface. When the part A of the sensor 41*a* is exposed to the drum peripheral surface by the action of the pin spring 47*a*, and the magnet 45*a* is moved away from the Hall element 52, the rotation of the drum shaft 13 begins. Thus, the next winding operation of the flyer 14 is restarted. Simultaneously, the transportation of the weft Y by the carriers 23 and 23' is also performed.

The rewinding of the weft Y starts concurrently with part A of the sensor 41*a* being exposed to the drum outer peripheral surface. Thus, the weft Y always remains wound about the base portion of the drum outer peripheral surface. Accordingly, the part A of the sensor 41*b* is in a buried state from the drum outer peripheral surface due to the remaining weft. The sensor 41*b* outputs a signal indicative of the presence of weft Y to the control unit. When the part A of the sensor 41*b* is exposed from the drum outer peripheral surface due to the action of the pin spring 47*b*, and when the magnet 45*b* moves away from the Hall element 52', the signal of the sensor 41*b* delivered to the control unit indicates the absence of the weft. The control unit stops the supply of the warp Y to this feeder and to the weaving machine.

The pin springs 47*a* and 47*b* have no initial tension applied thereto. Their base portions are supported by the fixed supporting members. As a result, since the weight of the springs 47*a* and 47*b* can be neglected, the weft detection by the sensors 41*a* and 41*b* is sensitive. Furthermore, since coil springs are not used, no problem involving weft dust accumulation on the coil springs disturbs the operation.

Next, with reference to FIG. 1, the operation of the driving section 12 and the mechanical type clutch C mounted thereon will be described.

The motor 12*a* of the means for rotating 12 is driven in a predetermined frequency range, so that the winding speed of the weft Y by the flyer 14 can be maintained at a constant speed.

Figure 12:
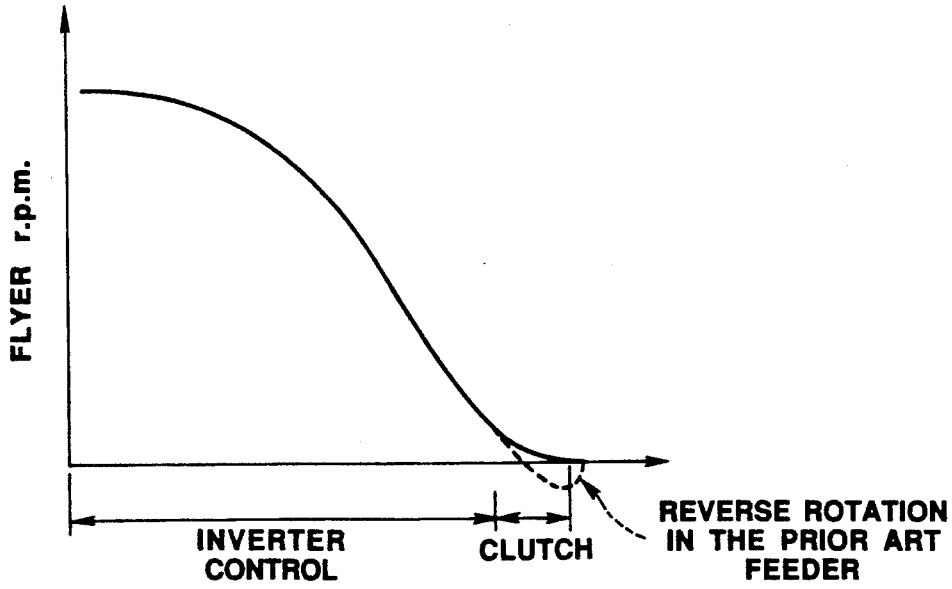
FIG. 12 is a characteristic diagram of the weft feeder over time until a flyer is stopped.
Figure 13A:
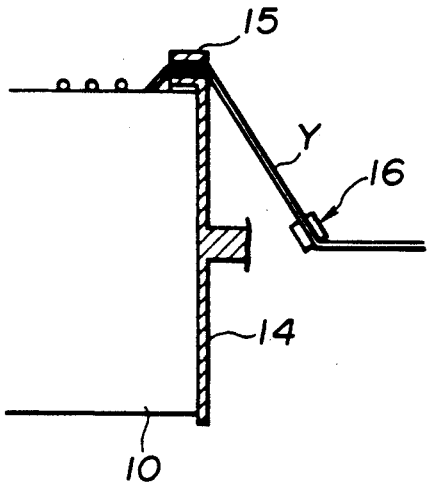
FIG.13A (PRIOR ART)
FIGS. 13A and 13B are diagrams respectively showing a normal state of the weft in a prior art weft feeder, and a generation of a torsion portion due to slack of the weft when the flyer is rotated in a reverse direction.
Figure 13B:
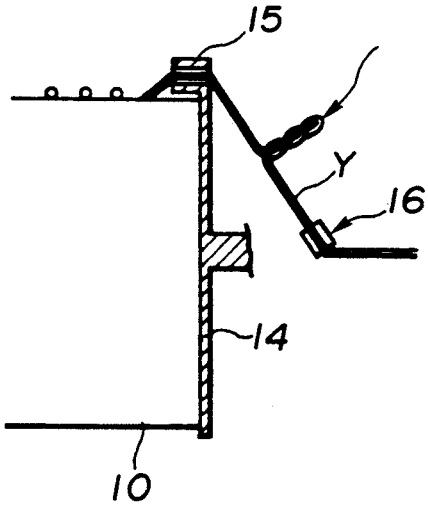
FIG.13B (PRIOR ART)
Figure 14:
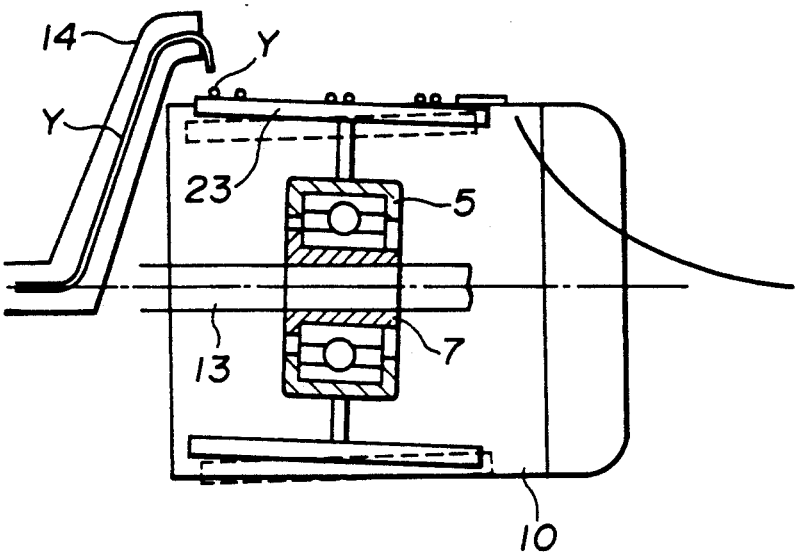
FIG. 14 (PRIOR ART)
FIG. 14 is a sectional view of a main part of a prior art weft feeder, and particularly a prior art carrier.
Figure 15:
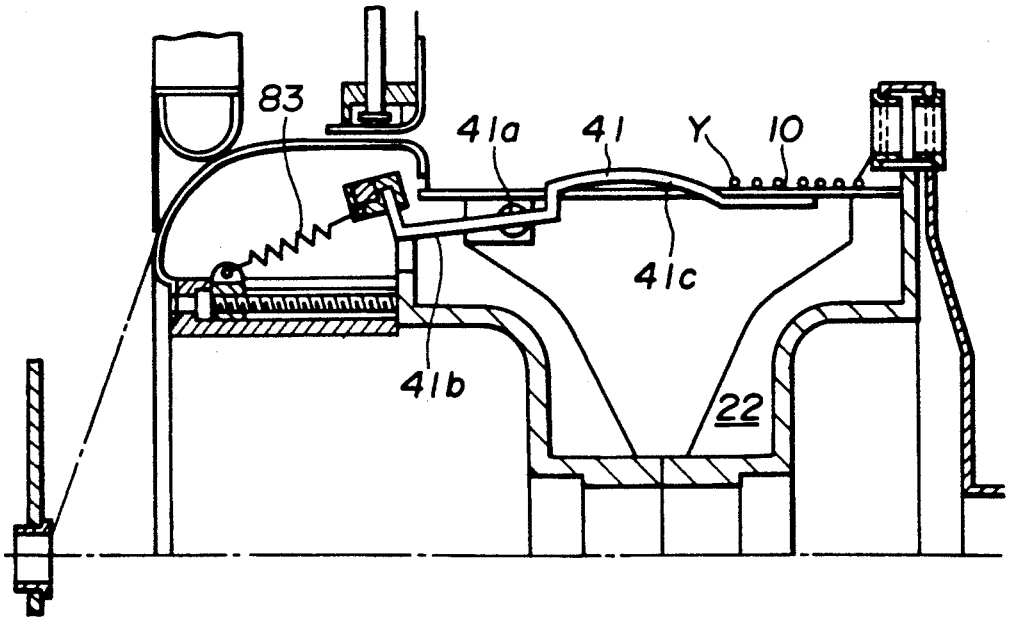
FIG. 15 (PRIOR ART)
FIG. 15 is a sectional view of a prior art weft feeder, particularly of the main part of a spring device for biasing a prior art sensor.

After the winding of the weft Y is completed, the frequency of the inverter is reduced to approximately 1 to 2 Hertz so that the motor 12*a* rotates by its inertia. The flyer 14 is braked and stopped by a frictional force of the mechanical clutch C, as shown in FIG. 12. In a conventional driving section, or means for rotating, having no mechanical clutch, the motor is rotated by its inertia for a few seconds after the winding of the weft is completed and the motor deenergized. At the instant of the motor stopping, the flyer rotates in a reverse direction due to the tension. Thus, by breaking and stopping the flyer in the above-identified manner, it is possible to completely avoid reverse rotation of the flyer.

Specifically, the motor, and thereby the flyer, is decelerated to rotational speed of 30 rpm to 60 rpm by applying a frequency of 1 Hz to 2 Hz by the inverter. This interrupts energization of the motor. Subsequently, while the motor rotates by its own inertia, the clutch is energized and attracts a friction plate (not shown in FIG. 12). The right end of the friction plate moves to the left to brake the motor shaft 16 thereby to stop the rotation of the flyer 14 connected to the motor shaft through the drum 13.

To start the flyer 14 again, the clutch is deenergized to release the friction plate. The motor is then energized, and the motor is accelerated by the inverter to rotate the flyer at a predetermined rotational speed. Furthermore, the stopped and locked condition can be maintained without external force.

Accordingly, the flyer 14 can be stopped by a mechanical braking force when the rotation of the flyer 14 approaches a certain speed. It is possible to prevent the flyer 14 from rotating in a reverse direction due to the tension of the weft.

Furthermore, since the means for rotating 12 is provided with the motor 12*a*, which can be controlled to decelerate by the inverter control, it is possible to decelerate to several r.p.m. or lower by virtue of the frequency control.

Furthermore, the control system can be made simple and at low cost by applying a three-phase motor to the motor 12*a*.

Having, thus, described the invention, what is claimed is:

1. A feeder for supplying weft to a weaving machine, the feeder comprising:

(a) a frame;

(b) a drum shaft having a central axis;

(c) means for rotating the drum shaft, the rotating means being mounted on the frame;

(d) a drum mounted upon the drum shaft, the drum having a plurality of radial slits formed therein, the drum being stationary;

(e) a flyer mounted upon and rotatable with the drum shaft;

(f) a plurality of carriers which are accommodated in the radial slits of the drum and are radially and axially movable with respect to the drum shaft each of the carriers being formed in a rectangular shape;

(g) means for supporting the carriers upon the drum shaft, the support means being orientated at an angle of inclination with respect to the center axis of the drum shaft, the means for supporting comprising:

(1) a pair of bushings axially disposed on the drum shaft and secured thereto;

(2) a pair of eccentric rings mounted upon and coupled to the bushings so as to allow the eccentric rings to tilt in an axial direction while preventing rotation relative to the bushings; and (3) a pair of support members mounted on the eccentric rings through a pair of bearings; and (h) means for adjusting the angle of inclination of the support means;

wherein the pair of support members are axially spaced from each other and respectively support opposite ends of a lower edge of each of the carriers, so that when the angle of inclination of the support means is adjusted to a predetermined inclination and the drum shaft is rotated, the pair of supporting members are simultaneously inclined back and forth in the axially direction and are oscillated simultaneously in the radial direction.

2. The feeder as set forth in claim 1, wherein the means for rotating comprises:

(a) a motor, and (b) a clutch, the clutch preventing reverse rotation of the flyer coupled to the drum shaft.

3. The feeder as set forth in claim 1, wherein the means for rotating comprises:

a motor having means for decelerating to a minimal rotational speed by frequency control to a minimum frequency, thereby to maintain a balance between a forward rotational force of the motor at the decelerated speed and tension of the weft to rotate the flyer in a reverse direction to prevent the reverse rotation of the flyer.

4. The feeder of claim 1, further comprising:

a warp guide to direct warp leaving the feeder.

5. A feeder for supplying weft to a weaving machine, the feeder comprising:

(a) a frame;

(b) a drum shaft having a central axis;

(c) means for rotating the drum shaft, the rotating means being mounted on the frame;

(d) a drum mounted upon the drum shaft, the drum having a plurality of radial slits formed therein;

(e) a flyer mounted upon and rotatable with the drum shaft;

(f) at least one carrier which is radially and axially movable with respect to the drum shaft;

(g) means for supporting the at least one carrier upon the drum shaft, the support means being oriented at an angle of inclination with respect to the center axis of the drum shaft; and (h) means for adjusting the angle of inclination of the support means, the means for adjusting the angle of inclination comprising:

(1) a rotatable dial, the dial having a slanted surface in contact with the means for supporting;

wherein the rotation of the dial after the contact of the dial and the means for supporting thereby alters the angle of inclination.

6. A feeder for supplying weft to a weaving machine, the feeder comprising:

(a) a frame;

(b) a drum shaft having a central axis;

(c) means for rotating the drum shaft, the rotating means being mounted on the frame;

(d) a drum mounted upon the drum shaft, the drum having a plurality of radial slits formed therein;

(e) a flyer mounted upon and rotatable with the drum shaft;

(f) a plurality of carriers which are radially and axially movable with respect to the drum;

(g) means for supporting the carriers upon the drum shaft, the support means being orientated at an angle of inclination with respect to the center axis of the drum shaft, the means for supporting comprising:

(1) a plurality of bushings axially disposed on the drum shaft;

(2) a corresponding plurality of eccentric rings mounted upon the bushings;

(3) a corresponding plurality of support members mounted on the eccentric rings; and (4) a corresponding plurality of bearings, the bearings disposed on the rings to allow rotation of the rings while the support members are stationary; and (h) means for adjusting the angle of inclination of the support means, the means for adjusting comprising a rotatable dial having a slanted surface in contact with the means for supporting; and wherein the bushings have an outer coupling surface to allow the rings to tilt in an axial direction while preventing the rings to rotate relative to the bushings, and the eccentric rings have a thin wall side and a thick wall side, the bushings, the eccentric rings and the dial cooperate to change the inclination angle of of the support means.

* * * * *